US007536790B2

(12) United States Patent
Ebenhoch

(10) Patent No.: US 7,536,790 B2
(45) Date of Patent: May 26, 2009

(54) HAIR CLIPPERS

(75) Inventor: Siegfried Ebenhoch, Hochheim (DE)

(73) Assignee: Wella AG, Darmstadt (DE)

( * ) Notice: Subject to any disclaimer, the term of this patent is extended or adjusted under 35 U.S.C. 154(b) by 141 days.

(21) Appl. No.: 10/523,048

(22) PCT Filed: Aug. 18, 2003

(86) PCT No.: PCT/EP03/09131

§ 371 (c)(1),
(2), (4) Date: Feb. 2, 2005

(87) PCT Pub. No.: WO2004/018160

PCT Pub. Date: Mar. 4, 2004

(65) Prior Publication Data

US 2006/0075640 A1 Apr. 13, 2006

(30) Foreign Application Priority Data

Aug. 16, 2002 (DE) ..... 102 38 335

(51) Int. Cl.
*B26B 19/20* (2006.01)
*B26B 19/22* (2006.01)

(52) U.S. Cl. ..... 30/223; 30/195; 30/210; 30/216

(58) Field of Classification Search ..... 30/42, 30/43.7, 194, 195, 208, 210, 216, 223
See application file for complete search history.

(56) References Cited

U.S. PATENT DOCUMENTS

| | | | | | |
|---|---|---|---|---|---|
| 2,119,792 | A * | 6/1938 | Parkin | 30/531 |
| 2,726,447 | A * | 12/1955 | Maloy | 30/202 |
| 3,217,409 | A * | 11/1965 | Proffitt | 30/199 |
| 3,797,109 | A * | 3/1974 | Yamada et al. | 30/43.1 |
| 4,930,217 | A * | 6/1990 | Wolf et al. | 30/43.92 |
| 5,325,589 | A * | 7/1994 | Kubo | 30/201 |
| 5,367,772 | A * | 11/1994 | Ogawa | 30/201 |
| 5,579,581 | A * | 12/1996 | Melton | 30/223 |
| 5,970,616 | A * | 10/1999 | Wahl et al. | 30/216 |
| 6,260,276 | B1 * | 7/2001 | Lebherz et al. | 30/201 |
| 2002/0162226 | A1 * | 11/2002 | Abraham et al. | 30/210 |

FOREIGN PATENT DOCUMENTS

| | | | |
|---|---|---|---|
| DE | 33 10 706 | A1 | 9/1984 |
| DE | 3310706 | A1 * | 9/1984 |
| DE | 43 17 530 | A1 | 12/1993 |
| DE | 297 24 477 | U1 | 9/2001 |
| EP | 0 147 134 | | 7/1985 |
| EP | 1 174 227 | A2 | 1/2002 |
| GB | 260 241 | | 4/1928 |
| WO | 02/36314 | A1 | 5/2002 |
| WO | WO0236314 | A1 * | 5/2002 |

* cited by examiner

*Primary Examiner*—Boyer D. Ashley
*Assistant Examiner*—Edward Landrum
(74) *Attorney, Agent, or Firm*—Michael J. Striker

(57) ABSTRACT

A hair cutting machine (10) having a handle (12) that contains an electromotive drive unit (49) and having a cutter head (16) that is disposed at the front handle end and, in the operating position of the handle (12), has a stationary blade (18) and an oscillating blade (20) disposed above it, the stationary and oscillating blades (18, 20) forming a cutting plane (22) that lies between the two blades (18, 20) and is inclined in relation to the longitudinal axis (24) of the handle (12). In the operating position of the handle (12), the cutting plane (22) is inclined downward in relation to the longitudinal axis (24) of the handle (12) and the oscillating blade (20) is disposed above the stationary blade (18), which makes it possible to produce a haircut that is comparable to a classic scissors cut (FIG. 9).

7 Claims, 10 Drawing Sheets

HAIR CLIPPERS

The present invention relates to a hair cutting machine as generically defined by the preamble to claim 1.

CROSS-REFERENCE

The invention described and claimed hereinbelow is also described in PCT/DE 03/09131, filed on Aug. 18, 2003 and DE 102 38 335.9, filed on Aug. 16, 2002. This German Patent Application, whose subject matter is incorporated here by reference, provides the basis for a claim of priority of invention under 35 U.S.C. 119 (a)-(d).

BACKGROUND OF THE INVENTION

The present invention relates generally to a hair cutting machine.

The best cutting results can generally be achieved with a pair of scissors; but a scissors cut requires an extremely high degree of manual dexterity and takes a lot of time. The scissors cut can achieve particularly harmonious transitions in the neck and side region. Since the scissors cut is comprised of numerous individual linear cuts, this produces a visual effect that is referred to as a soft haircut. In a haircut using a hair cutting machine, however, numerous individual, oblong, flush cut surfaces are produced, yielding a stepped effect that requires a time-consuming finishing with thinning shears in order to compensate for this stepped effect in a visually acceptable manner. But even with this additional measure, the result is nowhere near that of a classic scissors cut.

The object of the present invention is to produce a hair cutting machine similar to the species, which improves the hair cutting results so that they are equivalent to the results of a classic scissors cut. In addition, from an ergonomic standpoint, it should be possible for a user to use the hair cutting machine without requiring a change in operation, thus allowing the user to operate it in the accustomed way.

SUMMARY OF THE INVENTION

With the handle of the hair cutting machine in the operating position, because the cutting plane is inclined downward in relation to the longitudinal axis of the handle, with the oscillating blade disposed above the stationary blade, the oscillating blade on the cutter head of the hair cutting machine is oriented so that the oscillating blade produces a vibrating action with approximately 25 to 50 oscillations per second in order to continuously guide strands of hair into the stationary blade, which produces a fine, dense thinning of hair. This vibrating action of the oscillating blade is an additional characteristic and an important component for achieving a cutting result with a hair cutting machine equal to that of a scissors cut.

One advantage of the hair cutting machine according to the present invention is that it can mechanically produce a haircut that gives a visual impression similar to that of the classic scissors cut without the danger of injury to the scalp. Another essential advantage is that this hair cutting machine can produce a haircut in a significantly shorter amount of time than a classic scissors cut, therefore also yielding economic advantages.

The hair cutting machine has the following advantages:

The risk of cutting bare patches and "holes" is reduced to the greatest extent possible.

Ergonomic operation.

Reduced work time in comparison to a scissors cut.

The cut is clearly visible while working and the cutter can be securely held.

Simple contour cutting without having to rotate the hair cutting machine.

An exemplary embodiment of the present invention is shown in the drawings and will be described in greater detail below.

DETAILED DESCRIPTION OF THE PREFERRED EMBODIMENTS

Figure 1:
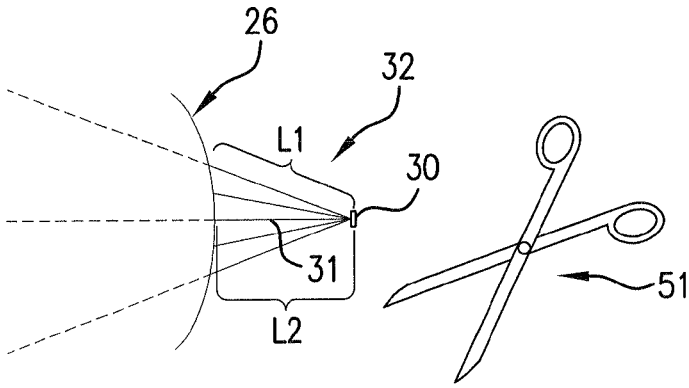
FIG.1 PRIOR ART
FIGS. 1 to 3 are schematic depictions for illustrating the cutting technique of the classic scissors cut (prior art)
Figure 2:
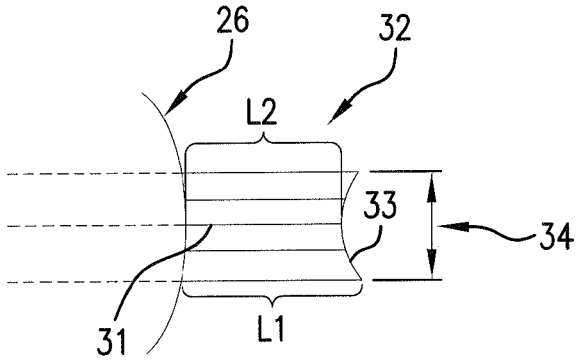
FIG.2 PRIOR ART
Figure 3:
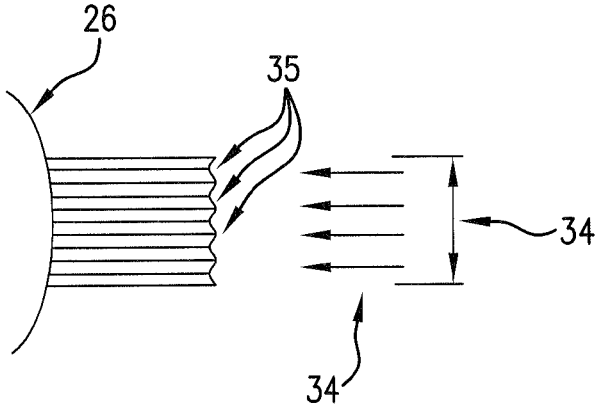
FIG.3 PRIOR ART

FIGS. 1 to 3 show a cutting technique using a pair of scissors 51. FIG. 1 shows that the strands of hair 32 cut with the scissors 51 have different lengths. This is intended to explain that a number of strands of hair 32 are simultaneously cut horizontally at one point, i.e. the cut 30. Since the strands of hair 32 above and below the cut 30 are a longer distance from the cut 30 than the hair 31 is to the cut 30, the strands of hair 32 remain longer than the hair 31 does from the cut 30. This is clearly depicted in FIG. 2 as a curved cut 33 in which the strands of hair 32 are drawn uniformly away from the scalp 26. A multitude of cuts 34 in succession yields a soft cut surface with small steps 35 so that the haircut can be referred to as soft (FIG. 3).

By contrast, a haircut using the hair cutting machine according to DE4317530 produces a flush cut since the strands of hair 32 are collected by a stationary blade 18 parallel to the cut surface 36 and are cut off flush.

When performing a haircut, the short hair at the neck and the sides is the hardest to work with in terms of cutting technique. The goal here is to produce a harmonious flow between the nape of the neck (hair length 0%) and the longer hair above it (hair length 100%). The cut surface is inclined in relation to the scalp and is referred to below as an inclined cut surface. But an inclined surface is also produced when no transition is cut and the hair at the nape of the neck has a length of 1 cm, for example, while the hair at the top of the head is 10 cm long, for example.

Figure 4:
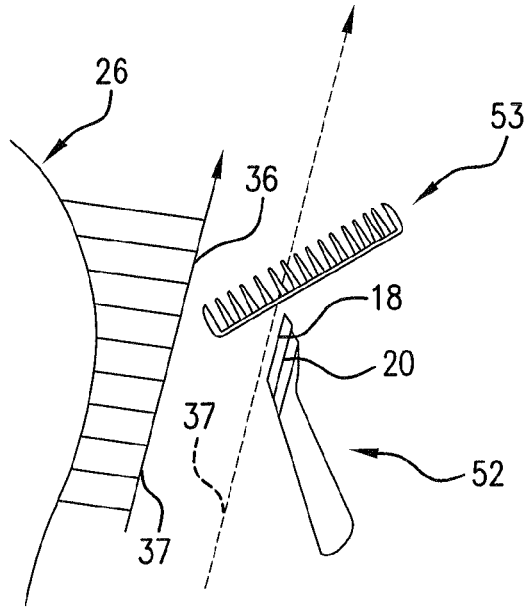
FIG.4 PRIOR ART
FIGS. 4 and 4*a* are schematic depictions for illustrating the cutting technique of a haircut using the known hair cutting machines (prior art)
Figure 4A:
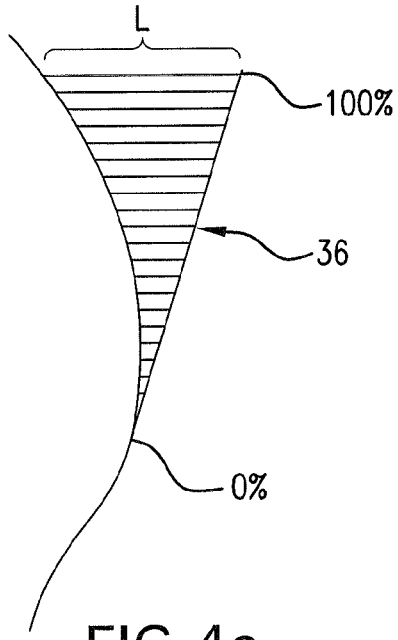
FIG.4a PRIOR ART

FIGS. 4 and 4*a* show the cutting technique with a conventional hair cutting machine 52. The hair cutting machine 52 is moved in a direction 37 along the desired cut surface 36 from 0% to 100% of the desired hair length L. This produces a hard, flush cut surface 36 without small steps, which gives the haircut an unharmonious look.

Is particularly difficult to guide the hair cutting machine 52, especially in the region of the nape of the neck, because a cutting comb 53 can no longer be placed underneath it. In order to assist in cutting hair, cutter attachments are often used, but these cannot be used to produce an inclined cut surface 36. Instead, these cutter attachments merely serve to prevent the machine from cutting undesirable steps and bare patches.

Figure 5:
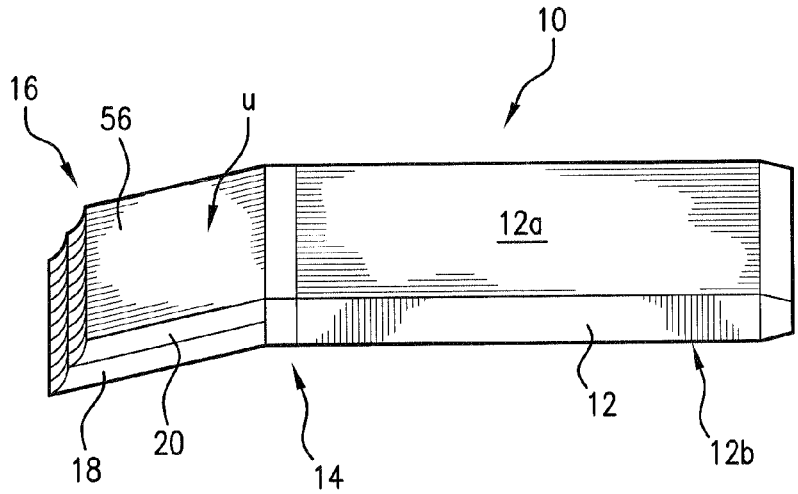
FIG. 5 shows a perspective view of the hair cutting machine.
Figure 6:
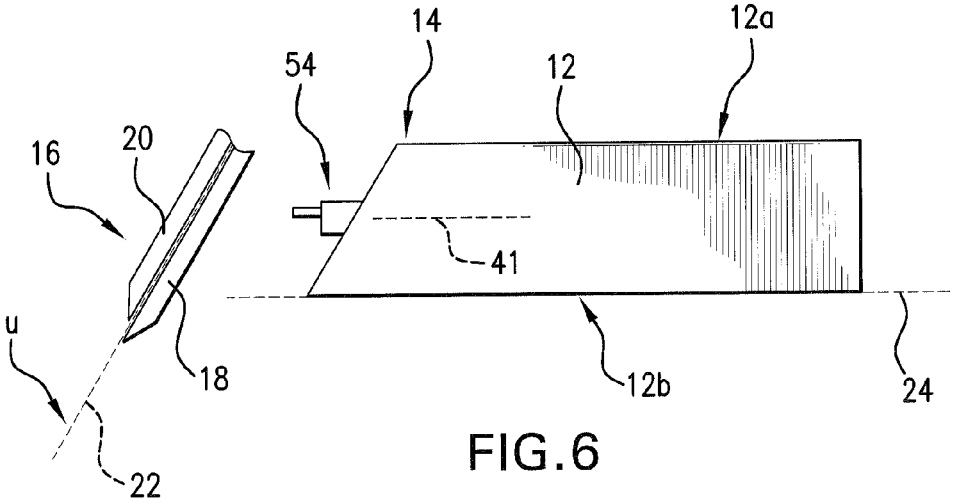
FIG. 6 shows a side view of the hair cutting machine with a cutter head.

The hair cutting machine 10 according to FIGS. 5 and 6 has a handle 12 with the top and bottom side 12*a*, 12*b*, which contains an electromotive drive unit, and has a cutter head 16 disposed at the front handle end 14, with the oscillating blade 20 disposed above the stationary blade 18. With the positive-angle hair cutting machine 10, when the hair cutting machine 10 is used in the usual flat operation, the angle (the relationship of the scalp 26 or the cut surface 28 to the cutting plane 22) is steeper than with conventional hair cutting machine 52, which improves results, especially those of transition cuts, and, due to a reduced error rate, makes it possible to work more quickly.

Figure 7:
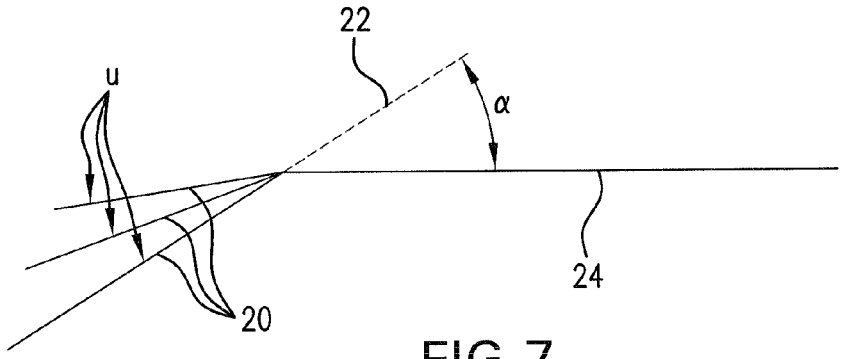
FIG. 7 is a schematic view for depicting the angle of the cutting plane in relation to the longitudinal axis.

FIG. 7 shows the angular relationship between the cutting plane 22 of the two blades 18, 20 and the longitudinal axis 24 of the hair cutting machine 10; the angle Alpha is 0 to 90°, preferably 0 to 45°, and even more preferably 5 to 35°. In actual use, an angle Alpha of approximately 30° has turned out to be optimal. The cutting plane 22 of the hair cutting machine 10 is inclined downward U in relation to the longitudinal axis 24. Since the oscillating blade 20 of the hair cutting machine 10 is disposed above the stationary blade 18 (FIG. 6), in the case of an eccentric drive unit 54, a metal pin 43 (FIG. 15) is provided, which is connected to an eccentric shaft 42 and a drive shaft 41; this metal pin 43 is guided through the lower stationary blade 18 via an opening 44 in order to be able to drive the upper oscillating blade 20 via an indentation 45.

Figure 8:
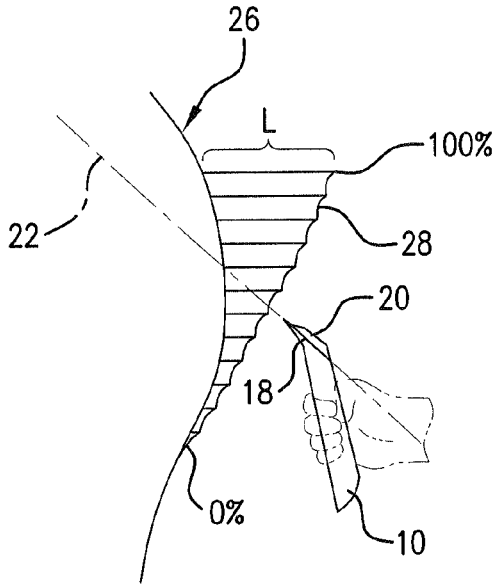
FIG. 8 is a schematic view of the positioning of the hair cutting machine in relation to the scalp.

FIG. 8 shows the guidance of the hair cutting machine 10 to produce a transition from 0 to 100% of the desired hair length L. The inclined cut surface is labeled with the reference numeral 28.

Figure 9:
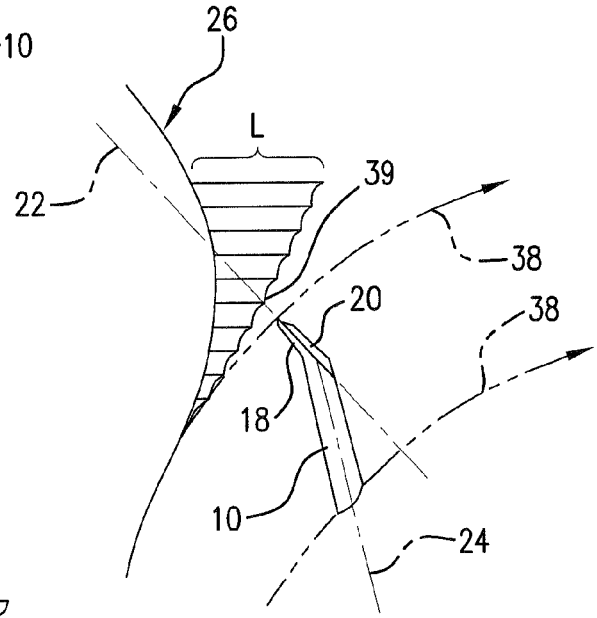
FIG. 9 shows how the hair cutting machine is guided.
Figure 9A:
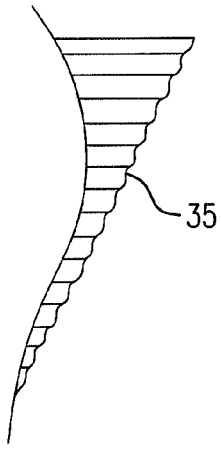
FIG. 9*a* shows the cutting results with the particular cutting technique.

FIGS. 9 and 9*a* show the particular cutting technique with the hair cutting machine 10, which is guided away from cuts 39 along curved paths 38. FIG. 9*a* shows the cutting result. A cutting result similar to that of a classic scissors cut is achieved, distinguished by a soft cut surface with the small steps 35.

The difference between a hair cutting machine 52 (FIG. 11) with a negative angle 47 in relation to the cut surface 36—which is generally known—and a hair cutting machine 10 (FIG. 10) with a positive angle 48 can best be seen when the longitudinal axis 24 is positioned vertically. If the oscillating blade 20 is disposed on the downwardly inclined side of the cutter head 16, then it is a negative angle 47 because when the hair cutting machine 52 is used, the effects of this negative angle become apparent in that this results in an almost inevitably parallel course of the cutting plane 22 in relation to the cut surface 36 because when the cutting plane 22 extends parallel to the cut surface 36, the stationary blade 18 collects the strands of hair flush to one another and immobilizes them, thus cutting them in a hard and/or smooth surface. If the moving blade 20 is disposed on top of the stationary blade 18, then it is a positive angle (FIG. 10) with all of the positively described advantages, for example the vibrating action (FIG. 12), in which, when cutting using the hair cutting machine 10 with a positive angle, the hair 42 is cut with an effect similar to that of a scissors cut due to a minimal thinning 40.

The inventor has discovered that surprisingly, the cutting results are significantly better the more steeply the cutter head of the hair cuffing machine, i.e. the cutting plane 22, is oriented toward the scalp since the strands of hair are not collected flush to one another and then cut, but instead, the rapid back-and-forth motion of the oscillating blade 20 first vibrates the hair (FIG. 12) when the machine is guided in the cutting direction 37. Only after the vibration does the stationary blade 18 collect the various strands of incoming hair, which are then immobilized and cut. As a result of this vibration, the cut surface 34 is clean, but the strands of hair are not cut flush; the hair is subjected to a minimal degree of thinning 40, which approximates the effect of a scissors cut.

In order to achieve a positive angle with a hair cutting machine, the operator can in fact rotate a conventional hair cutting machine by 180° around the longitudinal axis, but the vibrating action is not produced since the stationary blade collects and immobilizes the hair first so that no thinning can occur. There is also a danger of injury to the scalp since, the oscillating blade is oriented toward the scalp in this position. In addition, the hair is only poorly collected and insufficiently cut.

Another possibility is to rotate the hair cutting machine around the lateral axis in order to achieve a steeper alignment of the cutting plane in relation to the scalp. But holding the hair cutting machine at this angle requires the operator to keep it in an ergonomically unaccustomed position, which results in rapid fatigue.

The hair cutting machine according to the present invention achieves an outstanding cutting result in a position that is ergonomically favorable for the operator and does not involve the risk of injuring the scalp.

Figure 10:
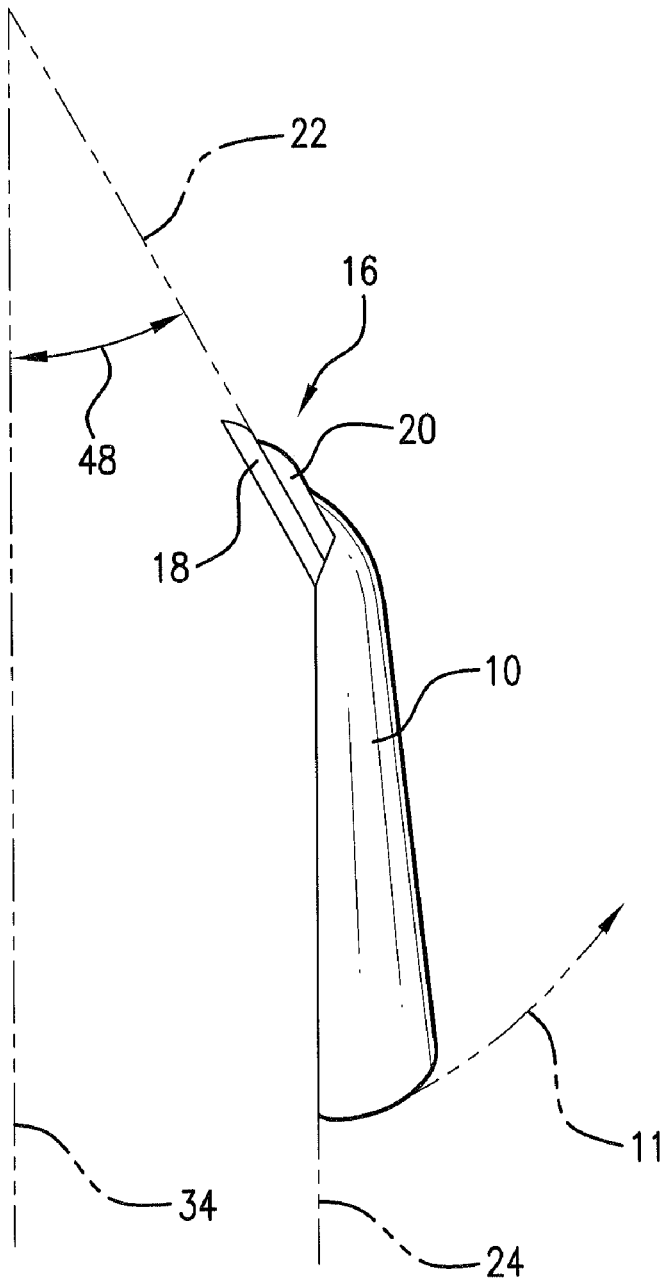
FIG. 10 schematically depicts the positive angle of the hair cutting machine in relation to the cut surface.

FIG. 10 shows the positive angle 48 of the hair cutting machine 10 when the longitudinal axis 24 is lifted 11 away from the cut surface 34; the cutter head 16 maintains its position spaced apart from the cut surface 34 and the cutter head 16 is oriented more steeply in relation to the cut surface 34. The oscillating blade 20 disposed on top initially vibrates the strands of hair 32 before they are held and cut once the stationary blade 18 immobilizes them.

Figure 11:
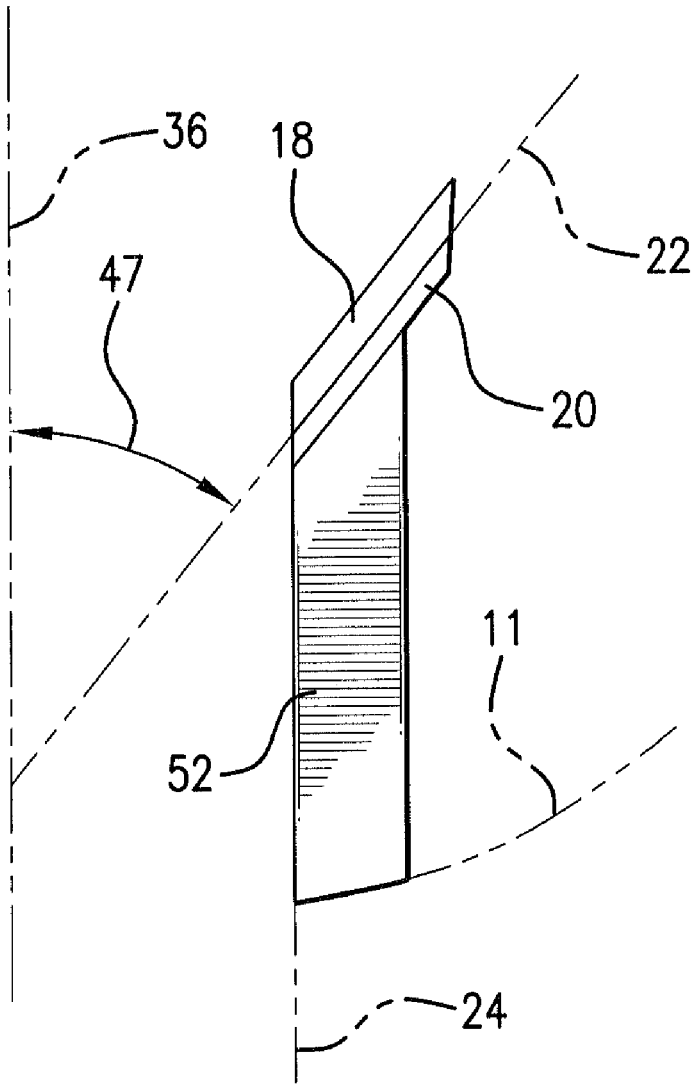
FIG. 11 PRIOR ART
FIG. 11 schematically depicts the negative angle of the hair cutting machine in relation to the cut surface.

FIG. 11 shows the negative angle 47 of the cutting plane 22 in relation to the cut surface 36. As soon as the user lifts 11 the longitudinal axis 24 in order to cut in the direction of the cut surface 36, this automatically produces a parallel, which results in a flush, hard cut 36 because the strands of hair are immobilized in the stationary blade 18 and cannot move when they are cut. It is not possible for the strands of hair to fall into the oscillating blade 20 because the stationary blade 18 has already collected and immobilized them.

Figure 12:
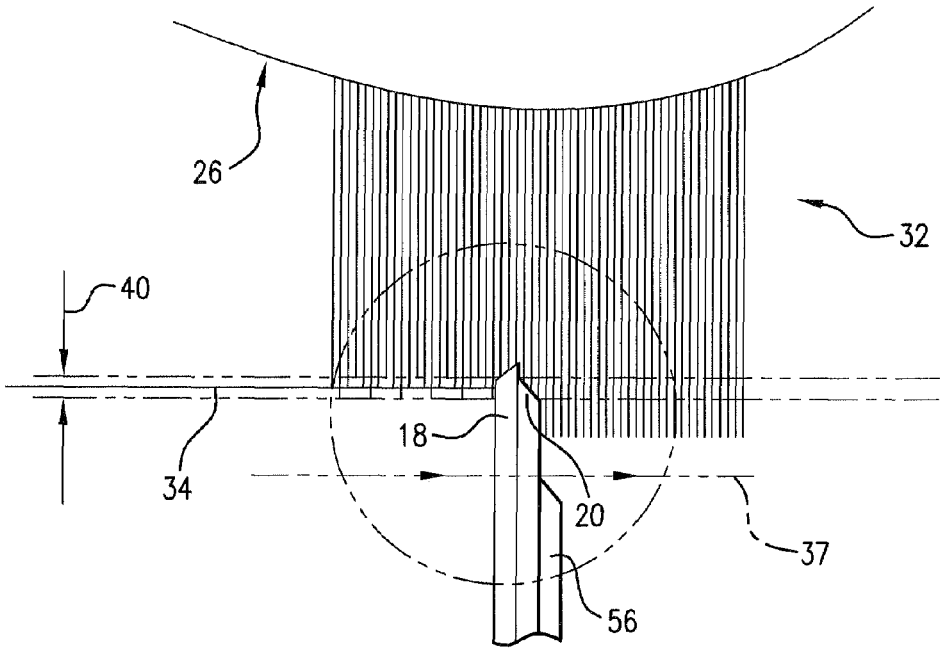
FIG. 12 schematically depicts a cutter head, which, due to the steeply inclined positioning of the cutting plane in relation to the cut surface, produces a thinned cutting result.
Figure 12A:
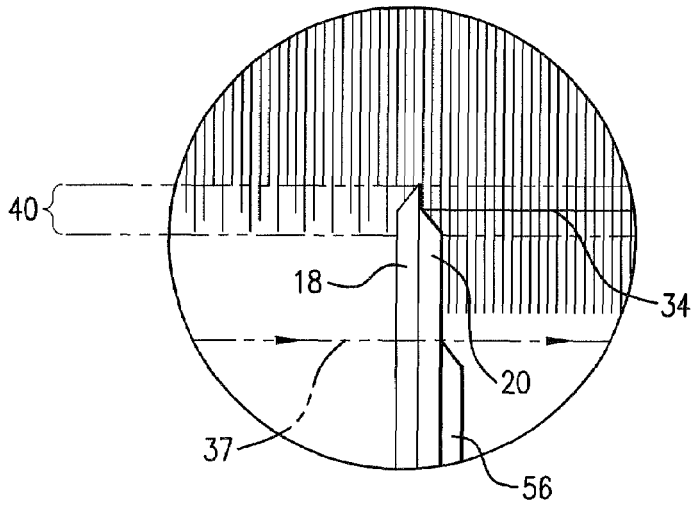

FIGS. 12 and 12*a* schematically depict vertically hanging strands of hair 32 that are collected in the cutting direction 37 by a cutter head 16, which has an oscillating blade 20 and a stationary blade 18. It is clear that the strands of hair 32 fall into the oscillating blade 20 first. The thinned region 40 thus produced in the cut surface 34 gives the machine cut, which has the positive inclination angle in relation to the cut surface 34, an appearance similar to that of a scissors cut because the strands of hair 32 are vibrated before being cut and are therefore unevenly collected and immobilized by the stationary blade 18 before being cut.

The decisive advantage of the hair cutting machine 10 according to the present invention lies in the inventor's discovery that the flatter (more parallel) the cutting plane 22 of the hair cutting machine 10 is to the cut surface 34, the harder or more progressive the haircut is. This is because all of the strands of hair 32 (FIG. 13) that first fall through the fixed, stationary blade 18 are immobilized by it and are therefore cut flush 36. However, if the cutting plane 22 is steeply aligned in relation to the cut surface 34, the haircut becomes softer and therefore more harmonious. This is due to the fact that at an angle of 45° to the scalp 26, the strands of hair 32 cannot fall as deeply into the blades 20, 18 of the hair cutting machine 10. As a result, by executing a number of short movements, the stylist can be more selective and can better recognize whether the desired hair length L has been reached. The hair cutting machine 10 also has the advantage that the hair cutting machine 10 is moved away 38 from the scalp 26 during cutting, without losing the vibrating action. Consequently, this prevents the cutting of unsightly bare patches and holes, which should also be of considerable significance to first-time employees.

Figure 13:
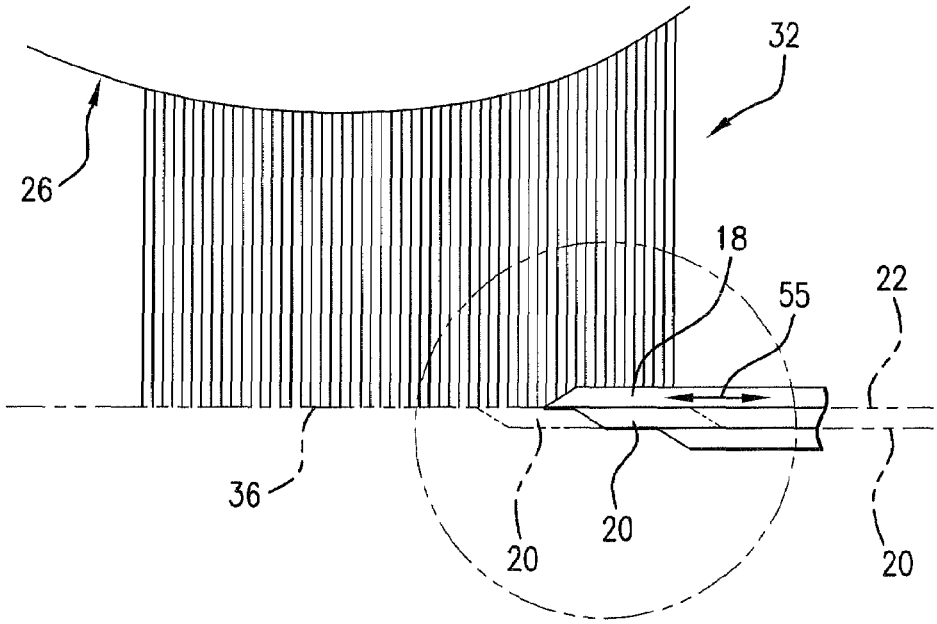
FIG. 13 schematically depicts a cutter head, which, due to the steeply inclined orientation of the cutting plane in relation to the cut surface, produces the flush cutting result.
Figure 13A:
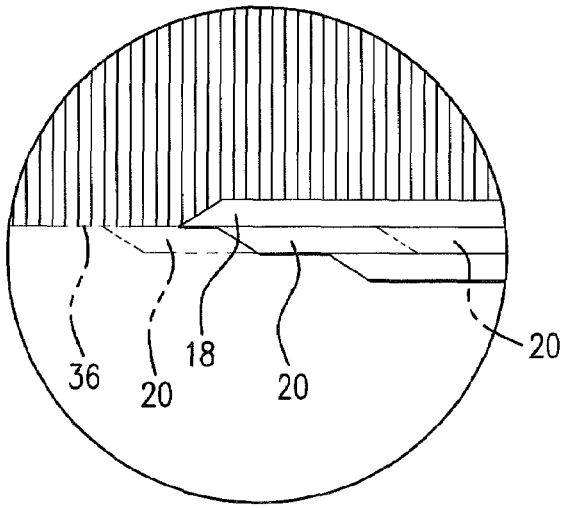

FIGS. 13 and 13*a* schematically depict the flush cutting 36 of the hair 32. It is clear that the strands of hair 32 are first immobilized by the stationary blade 18 before being cut by the oscillating blade 20. This produces a flush, hard haircut 36.

Figure 14:
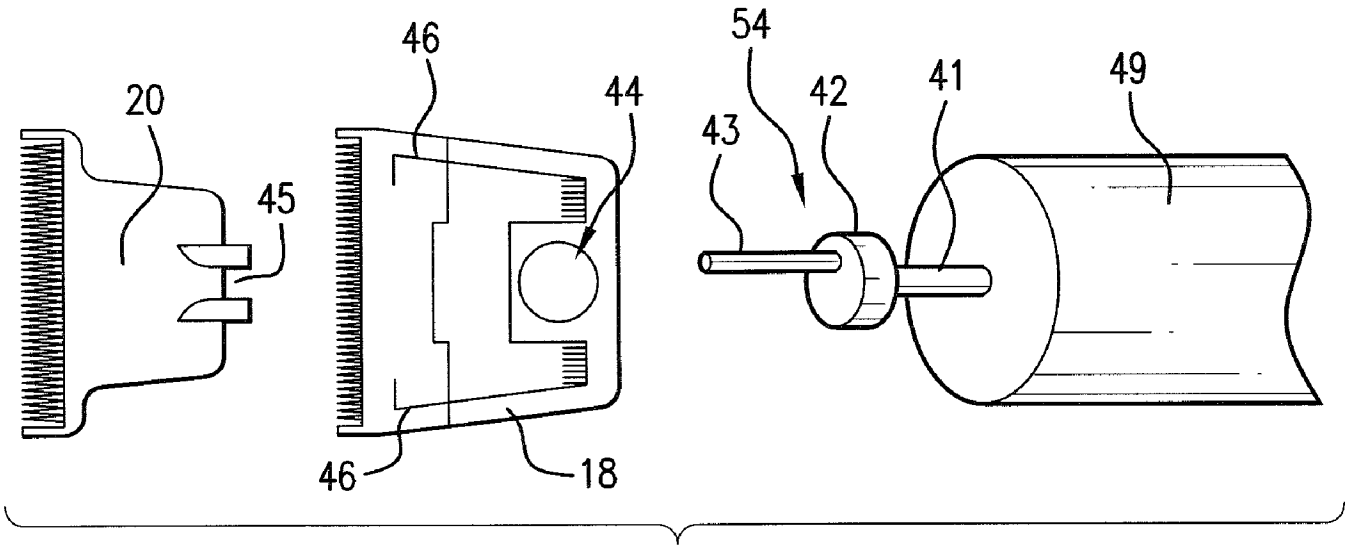
FIG. 14 shows a perspective view of the cutter head with its individual parts, including the motor and drive shaft.

FIG. 14 is an exploded view of an oscillating blade 20 and stationary blade 18 with an eccentric drive unit 54. An electric motor 49 drives a drive shaft 41 to which an eccentric shaft 42 is attached. A metal pin 43 is attached off-center to the opposite end of the eccentric shaft 42. This metal pin 43 is guided through the opening 44 in the stationary blade 18 and inserted into a catch 45 of the oscillating blade 20. The oscillating blade 20 and the retaining springs 46 are attached to the stationary blade 18 in a moving fashion by a parallelogram guide. The rotating motion of the eccentrically attached metal pin 43 causes the oscillating blade 20 to move back and forth since the retaining spring 46 leaves the moving blade enough free play to remain mobile. The cutter head 16 is attached to the hair cutting machine handle 12 by means of an intrinsically known snap connector system. This system of a parallelogram guide with a retaining spring 46 is intrinsically known from EP0147134B1, and is held to be fully disclosed herein.

Figure 15:
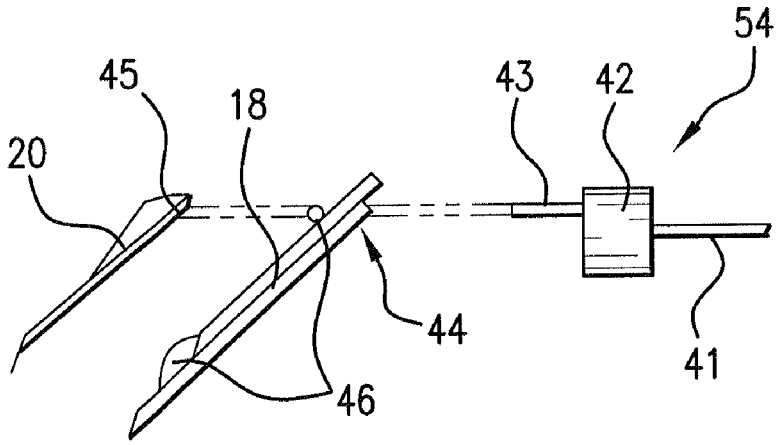
FIG. 15 shows a schematic side view of the drive shaft, stationary blade, and oscillating blade.

FIG. 15 shows a side view of FIG. 14.

Figure 16:
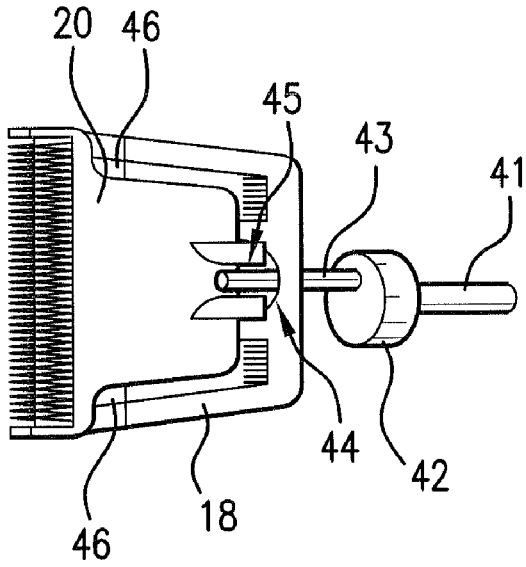
FIG. 16 shows the assembled cutter blade in which it is clear that the metal pin is guided through the stationary cutter blade and then protrudes into an indentation in the oscillating cutter blade.

FIG. 16 shows the assembled cutter head 16, in which the metal pin 43 has been inserted through the opening 44 in the stationary blade 18, into the catch 45 of the oscillating blade 20. However, it is also possible for the catch 45 to be elongated so that it is guided through the opening 44. In lieu of the opening 44, a recess that is not shown here can also be provided. Depending on how the metal pin 43 and the catch 45 cooperate, it could also be possible to eliminate an opening 44 or recess. In the hair cutting machine 10 with a positive angle in relation to the longitudinal axis 24, a motor 49 sets a drive shaft 41 in motion in order to drive the cutter head 16. This drive shaft 41 has a round eccentric shaft 42 slid onto it, with a metal pin 43 attached off-center to the opposite side of this eccentric shaft 42. When the motor 49 is switched on, it sets this metal pin 43 into a circular motion. In order to be able to drive the oscillating blade 20, the metal pin 43 must be guided through an opening 44 in the stationary blade 18. This opening 44 must be large enough that the moving metal pin 43 does not strike the stationary blade 18. The end of the metal pin 43 is inserted into the catch 45 of the oscillating blade 20. The retaining spring 46 attaches the moving blade 20 to the stationary blade 18; the retaining spring 46, however, leaves the moving blade 20 enough free play to allow it to move back and forth. The rotating motion of the metal pin 43 sets the oscillating blade 20 into a back-and-forth oscillation.

Because the inclination angle (Alpha) of the hair cutting machine 10 is designed to be adjustable, this permits it to be ergonomically adapted to the individual. Such an adjusting device is known, for example, from EP0147134B, for example from FIG. 30, which is held to be fully disclosed herein.

The fact that the oscillating blade 20 is designed to be adjusted in relation to the stationary blade 18 in the longitudinal direction 55 of the cutting plane 22 makes it possible to adjust the extent of the thinning 40 within certain limits.

The stationary blade 18 and the oscillating blade 20 are embodied in the form of an interchangeable cutter head 16, which permits this cutter head 16 to be interchanged with a conventional cutter head.

Part of the oscillating blade 20 is provided with a flat covering 56, which prevents cut strands of hair 32 from being able to collect on the oscillating blade 20.

REFERENCE NUMERAL LIST

10 hair cutting machine
11 lifting of the longitudinal axis
12 handle
12*a* top
12*b* bottom
14 handle end
16 cutter head
18 stationary blade (lower)
20 oscillating blade (upper)
22 cutting plane
24 longitudinal axis
26 scalp
28 inclined cut surface
30 cut
31 strand of hair
32 strands of hair
33 curved cut surface
34 cut surface
36 small steps
36 hard, flush cut surface
37 cutting direction
38 arc-shaped path
39 cut
40 minimal thinning
41 drive shaft
42 eccentric shaft
43 metal pin
44 opening in stationary blade
45 catch
46 retaining spring
47 negative angle
48 positive angle
49 motor
51 scissors
52 conventional hair cutting machine
53 cutting comb
54 eccentric drive unit
55 longitudinal direction
56 covering
L, L1, L2 hair length

What is claimed is:

1. A haircutting machine, comprising:

a handle (12) with a front handle end;

an electric drive unit (54) contained in the handle (12); and a cutter head (16) arranged at said front handle end;

wherein said cutter head (16) comprises a stationary blade (18) and an oscillating blade (20) disposed above the stationary blade (19) in an operating position of the handle (12) so that the stationary blade (18) and the oscillating blade (20) define a cutting plane (22) that extends there between and the cutting plane (22) is inclined in relation to a longitudinal axis (24) of the handle (12);

wherein the cutting plane (22) encloses a positive inclination angle ($\alpha$) of 0 to 90° to the longitudinal axis (24) of the handle and the oscillating blade (20) is adjustable in relation to the stationary blade (18) in a longitudinal direction (55) of the cutting plane (22);

wherein the stationary blade (18) is arranged between the oscillating blade (20) and the handle (12); and wherein the electric drive unit (54) contained in the handle (12) is connected to the oscillating blade (20) through an opening (44) provided in the stationary blade (18) in order to drive the oscillating blade.

2. The hair cutting machine as recited in claim 1, wherein said positive inclination angle ($\alpha$) is from 0 to 45°.

3. The hair cutting machine as recited in claim 1, wherein said positive inclination angle ($\alpha$) is from 5 to 35°.

4. The hair cutting machine as recited in claim 1, wherein said positive inclination angle ($\alpha$) is approximately 30°.

5. The hair cutting machine as recited in claim 1, further comprising an interchangeable cutter head (16) comprising the stationary blade (18) and the oscillating blade (20).

6. The hair cutting machine as recited in claim 1, wherein the cutter head (16) comprises a flat covering (56) that covers part of the oscillating blade (20) in order to prevent cut hair strands from collecting on the oscillating blade.

7. The hair cutting machine as recited in claim 1, wherein the positive inclination angle is adjustable.

* * * * *